United States Patent [19]

Lace

[11] 4,013,050

[45] Mar. 22, 1977

[54] IGNITION SYSTEM FOR A MULTIFUELED ENGINE

[75] Inventor: Melvin Arthur Lace, Prospect Heights, Ill.

[73] Assignee: Motorola, Inc., Schaumburg, Ill.

[22] Filed: Feb. 28, 1975

[21] Appl. No.: 554,281

[52] U.S. Cl. ..... 123/117 R; 123/121; 123/127

[51] Int. Cl.[2] ..... F02P 5/04

[58] Field of Search ..... 123/121, 117 R, 148 MC, 123/127, 27 GE, 120, 146.5 R, 148 DS

[56] References Cited

UNITED STATES PATENTS

| | | | |
|---|---|---|---|
| 1,622,164 | 3/1927 | Norvlel | 123/146.5 R |
| 1,886,566 | 11/1932 | Mallory | 123/117 R |
| 3,659,574 | 5/1972 | Reschke et al. | 123/121 |
| 3,707,953 | 1/1973 | Rhoades, Jr. et al. | 123/117 R |
| 3,718,000 | 2/1973 | Walker | 123/121 |
| 3,817,234 | 6/1974 | Jirousek | 123/117 R |

*Primary Examiner*—C. J. Husar
*Assistant Examiner*—David D. Reynolds
*Attorney, Agent, or Firm*—James W. Gillman; Donald J. Lisa

[57] ABSTRACT

A manually operable lever feeds a selected fuel to the engine. A cam having lobes made of a magnetic material is affixed to a shaft driven off the engine. Each of a plurality of reluctance pickups is predeterminedly positioned to form a magnetic circuit with the lobes at given engine angular positions. A mechanically operable switch feeds a selected pickup output to a triggerable ignition system. Linkage connects the switch to the manual lever.

8 Claims, 1 Drawing Figure

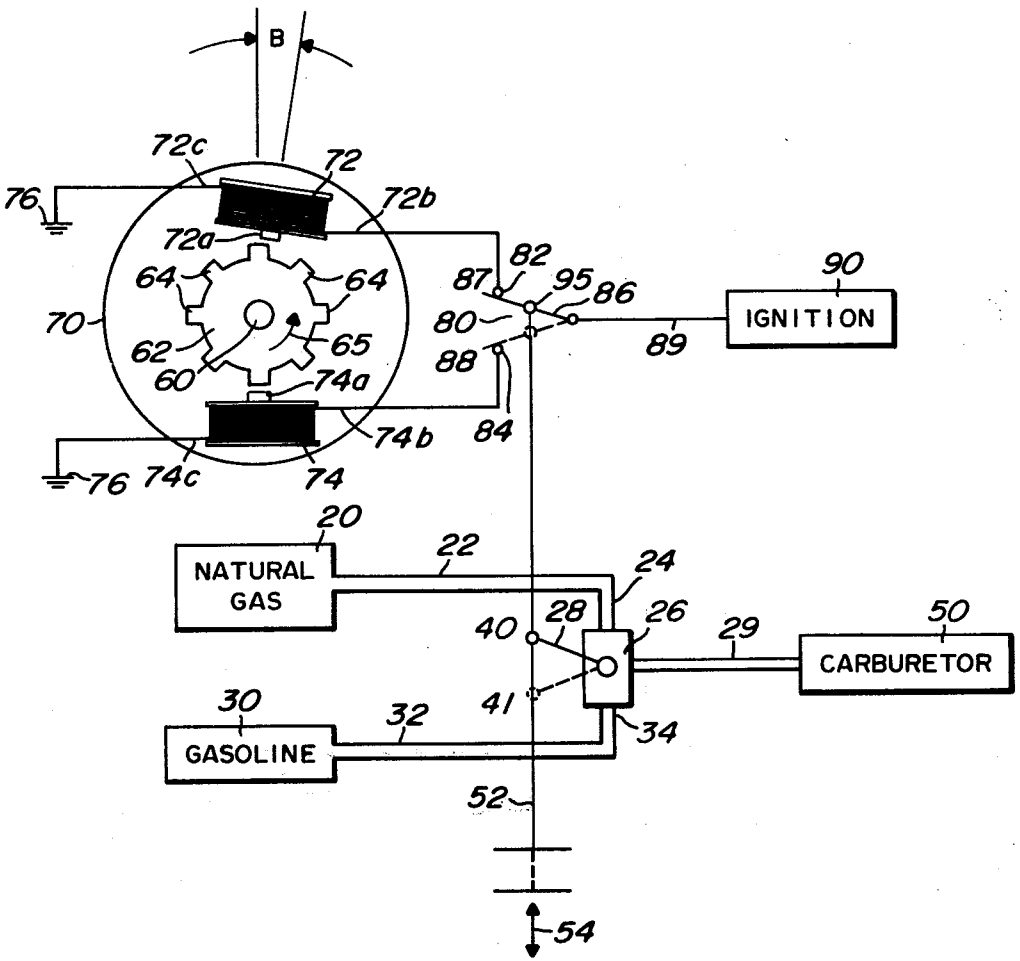
IGNITION
CARBURETOR
NATURAL GAS
GASOLINE
B
90
89
50
29
24
26
34
28
54
82
95
86
87
80
88
84
40
41
52
22
32
20
30
72b
72
64
65
74a
74b
74
72c
72a
64
62
60
74c
76
70
76

IGNITION SYSTEM FOR A MULTIFUELED ENGINE

BACKGROUND OF THE INVENTION

This invention relates to ignition systems for multifuel engines, and more particularly, to means for varying the static timing of the same.

Ignition timing is generally defined as the time in the engine cycle at which spark plug firing occurs. It is well known in the prior art that engine efficiency and performance can be optimized by varying the engine's ignition timing. In an early patent to Norviel (U.S. Pat. No. 1,622,164) an apparatus is provided whereby the operator of an engine powered vehicle may mechanically alter the static ignition timing of the engine. A subsequent patent to Mallory (U.S. Pat. No. 1,886,566) discloses a means to vary ignition timing in combination with throttle setting.

Conventionally, engines have used only gasoline as a source of fuel. However, as gasoline becomes increasingly more scarce, and produces undesirable pollutants, alternative fuel sources are being investigated. Some automobiles are being provided with two fuel tanks. The first contains gasoline whereas the second contains an alternative fuel, such as natural gas. A manually operated lever in the dashboard allows the vehicle operator to select which fuel is burned in the engine. It has been found that engine performance and efficiency can be optimized for a particular type fuel by adjustments in various engine systems. For example, U.S. Pat. No. 3,659,574, to Reschke, discloses a means for varying engine carburetion in response to a selected one of a plurality of possible fuels. However, there is no teaching in the prior art that engine efficiency and performance may be optimized by varying static ignition timing in response to the selected one of a plurality of fuels.

SUMMARY OF THE INVENTION

Therefore, it is an object of the present invention to optimize the performance and efficiency of an engine adapted to receive one of a plurality of fuels by providing means for varying the static ignition timing in response to the particular fuel selected.

Briefly, sensors produce triggering signals responsive to a predetermined engine angular position. Each sensor signal is fed to a respective input of a switch whose output connects to the triggerable ignition system. The switch has a manually operable control which allows a selected one of the inputs to be fed to the switch output, and thus to fire the engine ignition. As each sensor corresponds to a different time in the engine cycle, variable ignition timing is effected.

In multifuel vehicles wherein the operator selects a particular fuel via a manually operable lever positioned in the dashboard, linkage connecting the lever to the switch control allows simultaneous ignition timing changes corresponding to the fuel selected.

DESCRIPTION OF THE FIGURE

The FIGURE schematically illustrates a means for varying static ignition timing responsive to a selected engine fuel.

DETAILED DESCRIPTION OF A PREFERRED EMBODIMENT OF THE INVENTION

Referring to the FIGURE, a dual fuel static ignition timing system, as might be used in an engine powered vehicle, is shown. The two fuels available are natural gas and gasoline. The natural gas is contained in a first container 20 which connects via a feed line 22 to a first input 24 of a valve 26. The gasoline is contained in a second container 30 which is fed via a second feed line 32 to the second input 34 of valve 26. The valve 26 further comprises a mechanical control 28 which is operable in a first position 40 or a second position 41, and a valve output line 29 which connects to the fuel intake, or carburetor 50, of the engine. With valve control 28 in its first position 40 the fuel in container 20, namely the natural gas, is routed through first feed line 22 and through valve 26 to the valve output 29 and thereafter to the carburetor 50. With the valve control 28 in its second position, the fuel in the second container, namely the gasoline, is fed through the second feed line 32, through the valve 26 and thereafter through the valve output 29 to the carburetor. A control lever 52 is mechanically linked to the valve control 28 such that when the control lever is moved in either of two directions indicated at arrow 54 a selected fuel may be fed to the engine's carburetor 50. In an automotive vehicle, the control lever 52 may be located in the automobile's dashboard, thus allowing vehicle operator selection of the fuel to be burned.

A shaft 60 (shown in cross-sectional end view and understood to be extending into the drawing) is operably connected to the engine and driven thereby, such that the angular position of the shaft 60 is representative of the angular position of the engine. Affixed to the shaft 60 and rotatable therewith is a cam 62 having a plurality of lobes 64. The lobes 64 (and preferably the entire cam 62) are made of a magnetic material. Thus, as with a conventional engine distributor, engine rotation causes a proportional rotation of shaft 60, cam 62, and lobes 64, this angular rotation generally indicated in a direction given by arrow 65. The cam 62 is shown centrally located in a cylindrical distributor housing 70. Located within the housing 70 is a first sensor 72 and a second sensor 74. Each sensor 72, 74 is of the magnetic reluctance type. That is, each sensor has a pickup 72*a*, 74*a* respectively whereby when a magnetic material is in magnetic circuit configuration with the pickup, the sensor produces an output signal across its output terminals 72*b*, *c* and 74*b*, *c* respectively. In the preferred embodiment, the second terminal 72*c*, 74*c* of each sensor connects to vehicular ground 76. The first sensor output terminal 72*b* connects to the first contact 82 of a mechanically operated switch 80. The second sensor terminal 74*b* connects to a second switch contact 84. Switch 80 has a single pole 86 which is mechanically operable to connect, in a first position 87, to the first contact 82. In like manner, pole 86 is mechanically operable to a second position 88 whereat it connects to the second contact 84. Pole 86 connects via line 89 to a triggerable ignition system 90, examples of which are well known in the art.

Each sensor 72, 74 is located to be in magnetic circuit configuration with the lobes 64 at predetermined engine angular positions. Thus, for example, the instant a lobe 64 is opposite the pickup 72*a* of sensor 72 an output signal is developed across the sensor output terminals 72*b*, *c*, which signal is representative of a given angular position of the engine. Thus, a desired ignition timing may be effected by switching a selected sensor output signal to the triggerable ignition system 90. For example, in a natural gas - gasoline system, it was found that engine performance and economy could be increased if ignition firing for natural gas is advanced 12° on the cam. To effect this advance, the first sensor 72 has its pickup 72*a* located to be opposite a lobe 64 at an angle (shown as $\beta$) of 12° prior to the second sensor pickup 74 being opposite a lobe. By operating switch pole 86 to its first position 87 the proper timing for natural gas fuel is accomplished and, when switch pole 86 is in its second position 88, proper static ignition timing is accomplished for gasoline as a fuel. A mechanical linkage 95 coupling the switch pole 86 with the control lever 52 allows a simultaneous ignition timing change to be affected corresponding to a given change in input fuel fed to the engine.

Thus, a means has been described which alters static ignition timing in a predetermined manner in combination with a change in the fuel to be supplied to an engine.

While a preferred embodiment of the invention has been described, numerous variations thereof are possible all of which fall within the true spirit and scope of the invention.

I claim:

1. In the ignition system of an engine adapted to burn any one of a plurality of fuels
- means for automatically setting the static ignition timing to a predetermined one of several values responsive to the selection of the particular fuel to be burned.

2. The system as claimed in claim 1 wherein the variable ignition timing means comprises
- a plurality of sensing means, each sensing engine angular position and producing a trigger output responsive to a predetermined position thereof,
- triggerable ignition means, and
- switching means coupling a selected sensing means output to the triggerable ignition means.

3. The system as claimed in claim 2 wherein the sensing means further comprises
- a shaft operably connected to the engine and driven thereby, the angular position of the shaft representative of the angular position of the engine,
- a multilobed cam affixed to the shaft and rotatable therewith, each lobe constructed of magnetic material, and
- reluctance pickups positioned to be in magnetic circuit configuration with the lobes at predetermined engine angular positions.

4. In an engine powered vehicle adaptable to burn one of a plurality of fuels
- means operable to feed a selected fuel to the engine,
- means for setting the engine static ignition timing to a plurality of values, and
- means coupling the variable timing means to the fuel selecting means,
- whereby engine static ignition timing is set responsive to the selected engine fuel.

5. The adaptable vehicle as claimed in claim 4 having the fuel selecting means comprising
- a container for each of the fuels,
- a feed line from each container,
- a valve system having multiple inputs, an output, and a control means, and
- a manually operable lever
- wherein each container feed line connects to a valve system input,
- the valve system output connects to the fuel intake of the engine, and the manually operable lever connects to the valve control means,
- whereby
- manual operation of the lever selects a desired engine fuel.

6. The adaptable vehicle of claim 5 having the variable timing means comprising
- a shaft operably connected to the engine and driven therefrom, the angular position of the shaft representative of the angular position of the engine,
- a multilobed cam, each lobe comprised of a magnetic material,
- a plurality of reluctance pickups; each pickup producing a trigger output when in magnetic circuit configuration with a magnetic material,
- switching means having a plurality of inputs,
- an output, and a manually operable control,
- the position of the control coupling a selected input to the output, and
- triggerable ignition means wherein
- the cam is affixed to the shaft to rotate therewith,
- each pickup is positioned in magnetic circuit configuration with the lobes at predetermined positions of the engine,
- each pickup output connects to a switching means input, and
- the switching means output connects to the triggerable ignition means.

7. The adaptable vehicle as claimed in claim 6 including the coupling means comprising a mechanical linkage operably connecting the manual switch control to the valve lever.

8. In an engine powered vehicle adaptable to burn one of a plurality of fuels,
- means operable to feed a selected fuel to the engine including a manually operable lever the position of which selects the desired fuel,
- pickup means including a plurality of reluctance pickups predeterminedly located with respect to lobes on a cam driven off one engine,
- triggerable ignition means,
- means switching a mechanically selected one of the pickup outputs to the ignition means,
- means linking the switching means to the fuel selecting means.

* * * * *